US011123975B1

(12) United States Patent
Jurman

(10) Patent No.: US 11,123,975 B1
(45) **Date of Patent: *Sep. 21, 2021**

(54) SCREEN PRINTING PRESS

(71) Applicant: Gary Paul Jurman, Tampa, FL (US)

(72) Inventor: Gary Paul Jurman, Tampa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/462,991

(22) Filed: Mar. 20, 2017

Related U.S. Application Data

(63) Continuation of application No. 14/471,021, filed on Aug. 28, 2014, now Pat. No. 9,630,393.

(60) Provisional application No. 61/882,322, filed on Sep. 25, 2013.

(51) Int. Cl.
*B41F 15/02* (2006.01)
*B41F 15/18* (2006.01)
*B41F 15/34* (2006.01)

(52) U.S. Cl.
CPC ..... *B41F 15/18* (2013.01); *B41F 15/02* (2013.01); *B41F 15/34* (2013.01)

(58) Field of Classification Search
CPC ..... B41F 15/08; B41F 15/10; B41F 15/12; B41F 15/18; B41F 15/34; B41F 15/36; B41F 15/0813; B41F 15/0863
See application file for complete search history.

(56) References Cited

U.S. PATENT DOCUMENTS 4,226,181 A * 10/1980 Ericsson ..... B41F 15/36 101/127.1
5,127,321 A * 7/1992 Proffer ..... B41F 15/10 101/114
5,315,929 A * 5/1994 Sundqvist ..... B41F 15/0863 101/127.1
5,613,436 A * 3/1997 Taylor ..... B41F 15/0863 101/115
5,622,108 A * 4/1997 Benedetto ..... B41F 15/0804 101/126
6,883,425 B2 * 4/2005 Goss ..... B41F 15/0813 101/115

FOREIGN PATENT DOCUMENTS

JP 11-042761 * 2/1999 ..... B41F 15/36

* cited by examiner

*Primary Examiner* — Matthew G Marini
*Assistant Examiner* — Marissa Ferguson-Samreth
(74) *Attorney, Agent, or Firm* — Ted Masters

(57) ABSTRACT

A screen printing press includes a base and a clamping mechanism which is connected to the base. The clamping mechanism has a first member, a second member disposed perpendicular to the first member, and an edge. The clamping mechanism has X, Y, and Z axes, The screen has a first surface and a second surface perpendicular to the first surface. A protruding stop is disposed on at least one of the first surface and the second surface. The screen is positioned in the clamping mechanism so that the first surface abuts the first member, the second surface abuts the second member, and the protruding stop abuts the edge. The base includes an open frame which defines a volume which is shaped and dimensioned to receive a burn unit, so that when the burn unit is placed within the volume the burn unit is visible.

11 Claims, 9 Drawing Sheets

Fig. 3
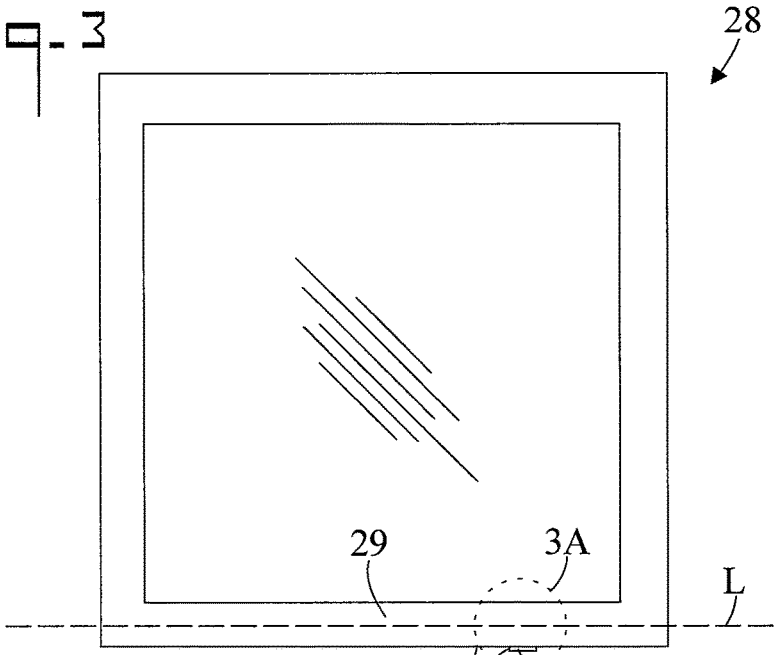
Fig. 4
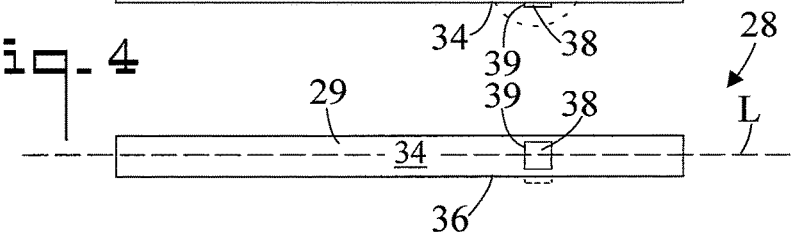
Fig. 5
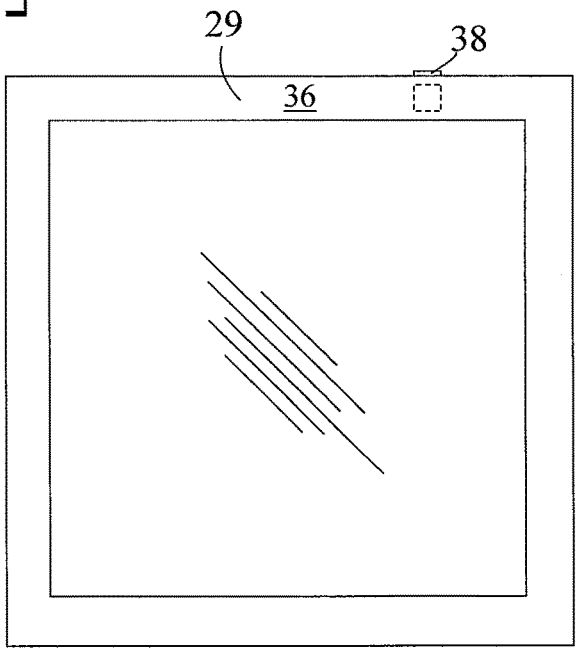
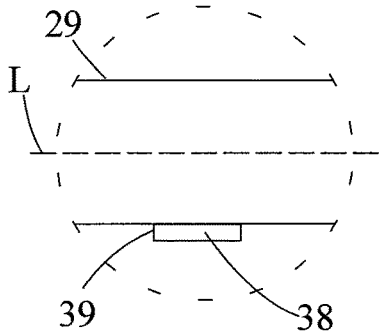
Fig. 3A

Fig. 9
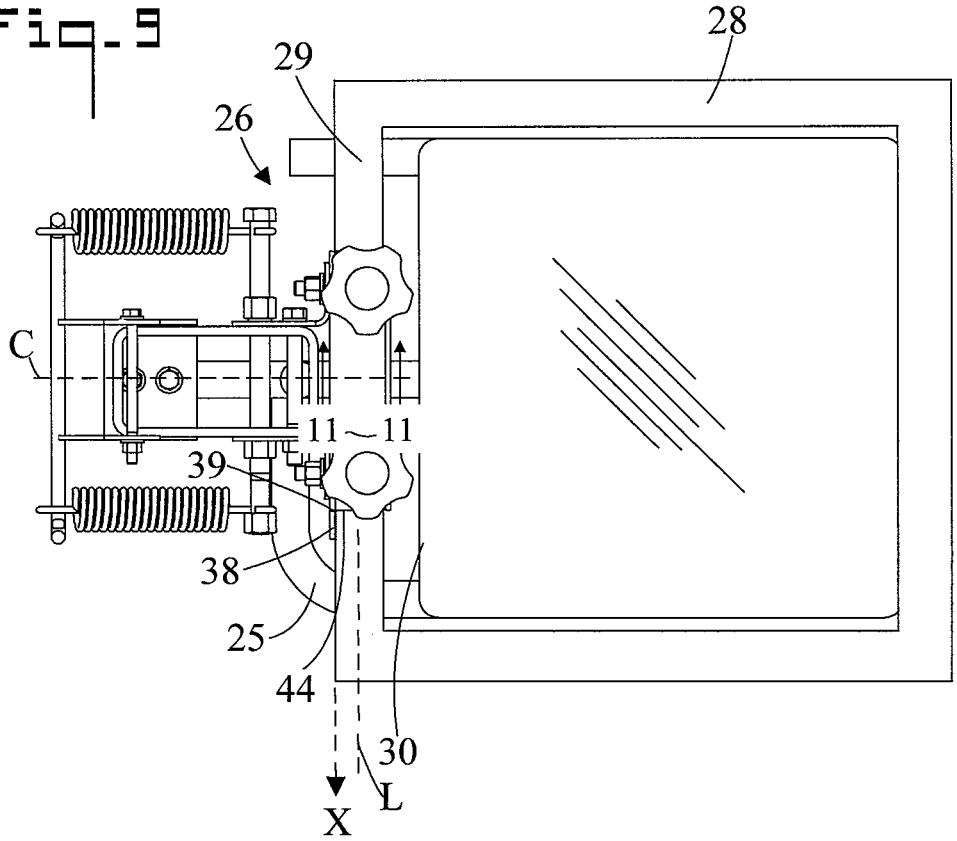
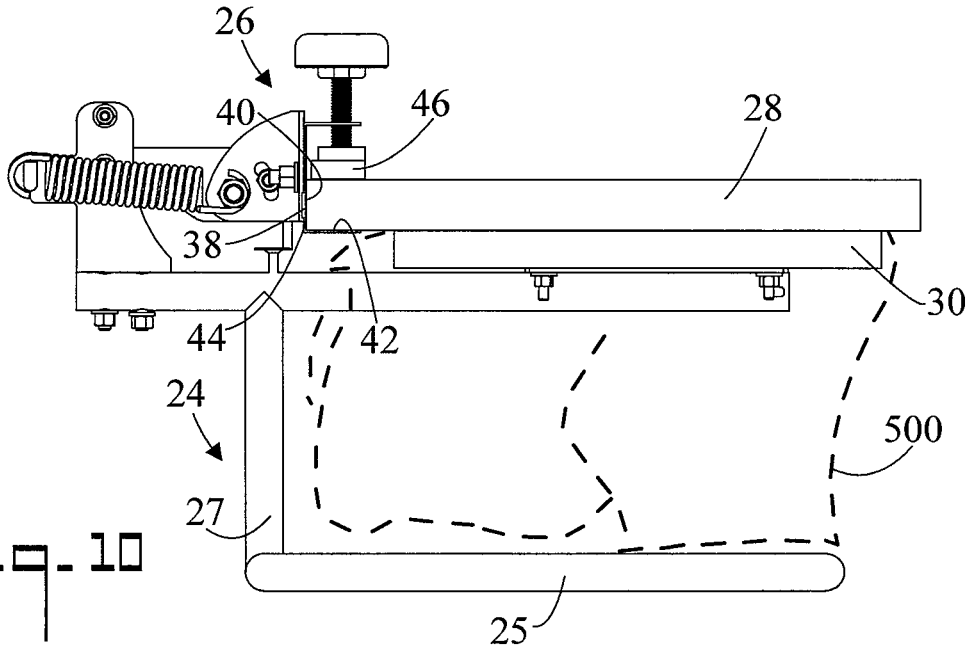
Fig. 10

SCREEN PRINTING PRESS

CROSS REFERENCE TO RELATED APPLICATION

This application is a Continuation of and claims the filing benefit under 35 U.S.C. § 120 of application Ser. No. 14/471,021, filed Aug. 28, 2014, which is hereby incorporated by reference. This application also claims the filing benefit under 35 U.S.C. § 119(e) of U.S. Provisional Application No. 61/882,322, filed Sep. 25, 2013, which is hereby incorporated by reference.

TECHNICAL FIELD

The present invention generally pertains to screen printing presses, and more particularly to a screen printing press which includes a registration system and method for accurately positioning a screen in the screen printing press.

BACKGROUND OF THE INVENTION

Screen printing presses are well known in the art. These devices utilize a screen to print an image on a substrate. The image is "burned" onto the screen using a positive transparency and a burn unit. Ink is then applied and passes through the screen and onto the substrate.

Problems exist in screen printing presses with respect to providing accurate screen registration when printing multiple colors. While screen mounted registration systems exist, they suffer from wear of crucial parts and require precision mounting of registration pins to function. The registration pins have a small surface area for contact, causing wear to have a more profound effect on registration. Also, such registration pins must be precisely oriented in the x-y-z coordinate system or fail, causing greater accuracy requirements in the mounting process.

Further, some screen printing presses utilize an "all-in-one" packaging design, wherein all press components are integrated into a single device. However, the performance of these presses can be degraded because they must necessarily balance the needs of competing functional requirements. In that regard, some miniaturized integrated systems use the base of the press to house various press components such as the burn unit. This approach can interfere with the placement of the substrate onto the printing platen, and also slow production of finished products. Locating press components within the base also inflates the size of the press. Also, presses which house the burn unit in the base, allow overspray from adhesives to collect on and impede crucial components. Problems can also arise with the size of the press being too large for the available work space and storage area.

Accordingly, there is a need for a screen printing press which has a registration system which is easy to use, and provides improved registration between colors on a single press, particularly when screens are interchanged. There is also a need for providing a press which provides a burn unit which is easily stored and removed from a work space.

BRIEF SUMMARY OF THE INVENTION

The present invention addresses the previously-mentioned deficiencies by providing a screen printing press with superior screen registration and mechanical features. The screen registration apparatus of the present invention allows a user to quickly and accurately register a screen in three axes of the clamping mechanism of the print head. Additionally, the base of the screen printing press provides for convenient storage and display of the burn unit. As such, the screen printing press provides a device which looks like a single integrated unit, but which in fact has the advantages of two separate elements which can either function together or be used separately.

In accordance with an embodiment, a screen printing press includes a base. A clamping mechanism is connected to the base, the clamping mechanism has a first member, a second member, and an edge. A screen is shaped and dimensioned to be received and clamped by the clamping mechanism, the screen includes a registration side having a first surface and a second surface disposed perpendicular to the first surface, a protruding stop is disposed on the registration side. The registration side has a longitudinal axis. The clamping mechanism has a X axis, a Y axis, and a Z axis, the axes have a common origin, wherein in the X axis the origin is the edge, in the Y axis the origin is the first member, and in the Z axis the origin is the second member. The first member provides registration of the screen only in the Y axis; the second member provides registration of the screen only in the Z axis, and the protruding stop provides registration of the screen only in the X axis. The screen is positionable in the clamping mechanism so that the first surface of the registration side abuts the first member of the clamping mechanism, the second surface of the registration side abuts the second member of the clamping mechanism, and the protruding stop abuts the edge of the clamping mechanism.

In accordance with another embodiment, the screen is positionable in the clamping mechanism so that the longitudinal axis of the registration side of the screen is parallel with the X axis. In accordance with another embodiment, when so positioned, the edge is perpendicular to the longitudinal axis of the registration side.

In accordance with another embodiment, the protruding stop has a registration edge which extends perpendicular to the longitudinal axis of the registration side. When positioned in the clamping mechanism, the registration edge of the protruding stop abuts the edge of the clamping mechanism.

In accordance with another embodiment, the first member is a back plate; and, the second member is a bottom plate.

In accordance with another embodiment, the edge is part of the first member and part of the second member.

In accordance with another embodiment, a junction of the back plate with the bottom plate has a first radius of curvature, and a junction of the first surface of the registration side with the second surface of the registration side has a second radius of curvature, the second radius of curvature being equal to or greater than the first radius of curvature.

In accordance with another embodiment, when positioned in the clamping mechanism, the screen is substantially centered in the clamping mechanism.

In accordance with another embodiment, a position of the protruding stop along the longitudinal axis of the registration side causes the screen to be substantially centered in the clamping mechanism.

In accordance with another embodiment, the protruding stop is positionable along the longitudinal axis.

Other embodiments, in addition to the embodiments enumerated above, will become apparent from the following detailed description, taken in conjunction with the accompanying drawings, which illustrate, by way of example, the principles of the screen printing press.

BRIEF DESCRIPTION OF THE DRAWINGS

FIG. 3 is top plan view of a screen;

FIG. 3A is an enlarged view of area 3A of FIG. 3;

FIG. 4 is a side elevation view of the screen;

FIG. 5 is a bottom plan view of the screen;

FIG. 9 is a top plan view of the screen printing press without the burn unit installed;

FIG. 10 is a side elevation view of the screen printing press without the burn unit installed and a substrate in position for printing;

DETAILED DESCRIPTION OF THE INVENTION

Figure 1:
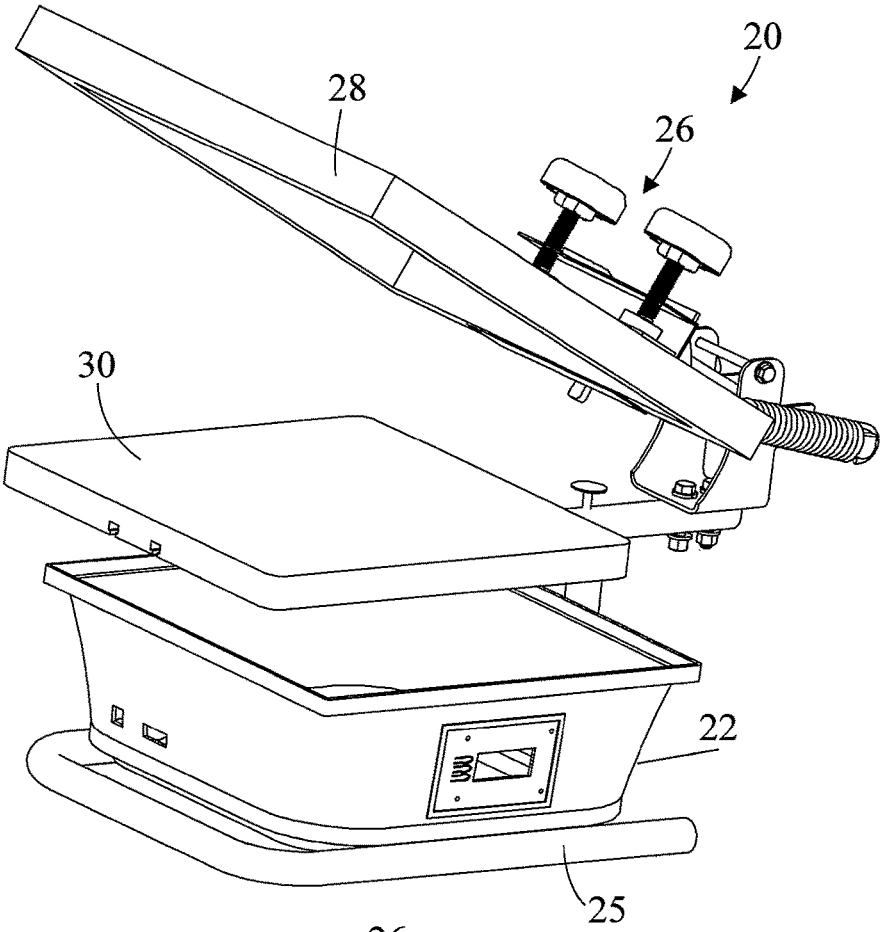
FIG. 1 is a perspective view of a screen printing press in accordance with the present invention.
Figure 2:
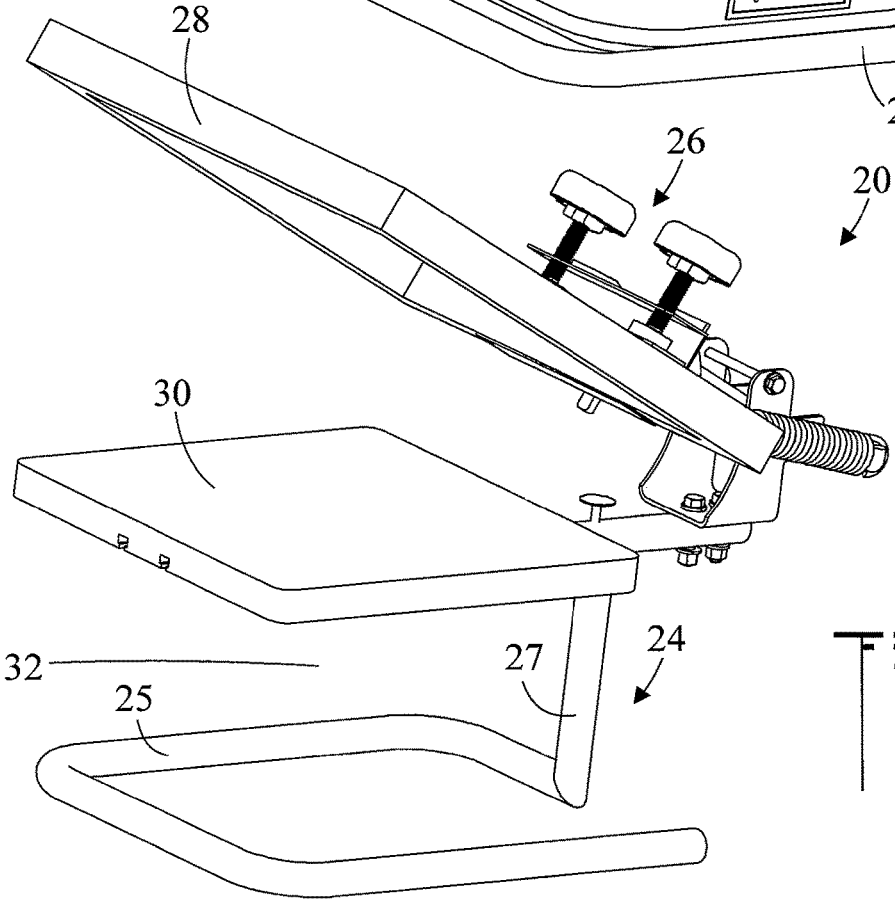
FIG. 2 is a perspective view of the screen printing press without a burn unit installed.

Referring initially to FIGS. 1 and 2, there are illustrated perspective views of a screen printing press 20 with and without a burn unit 22 installed respectively. Screen printing press 20 includes a base 24. A clamping mechanism 26 is connected to base 24. In the shown embodiment, clamping mechanism 26 is pivotally connected to base 24 so that it can be rotated to the shown up substrate loading position, or to the down (a) substrate printing position of FIG. 10) and (b) on-unit burning position of FIG. 17. A screen 28 is shaped and dimensioned to be received and clamped by clamping mechanism 26. A platen 30 which supports a substrate 500 to be printed (such as a T-shirt) is connected between base 24 and clamping mechanism 26 (refer also to FIG. 10).

Figure 14:
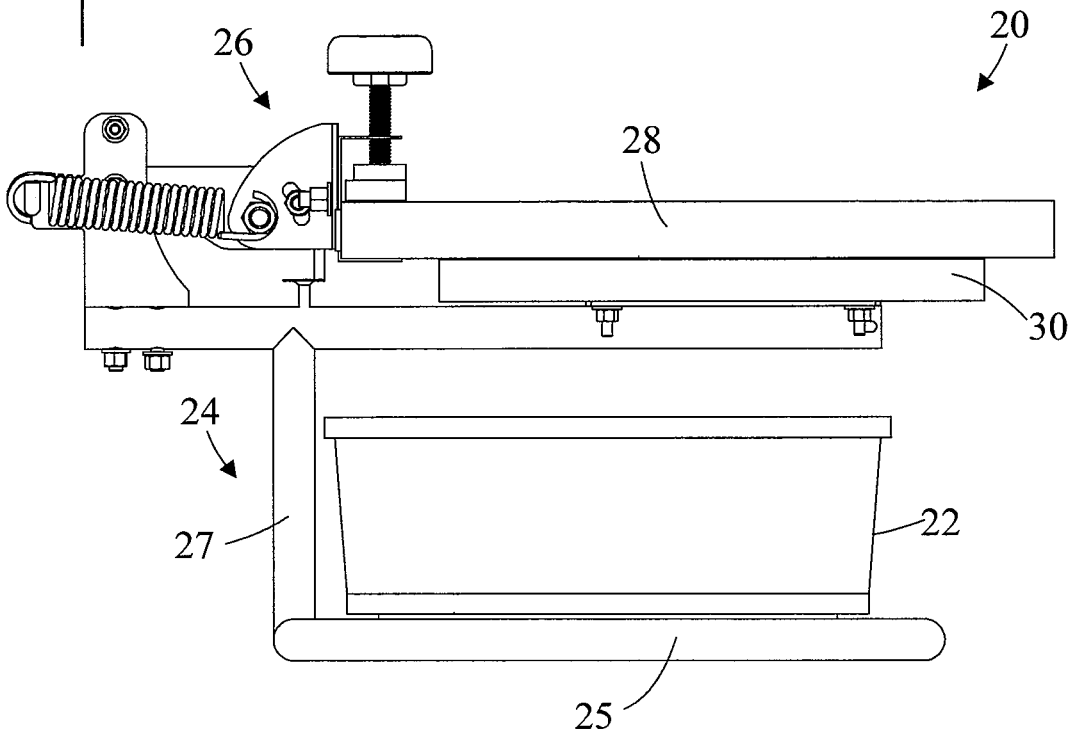
FIG. 14 is a side elevation view of the screen printing press.
Figure 15:
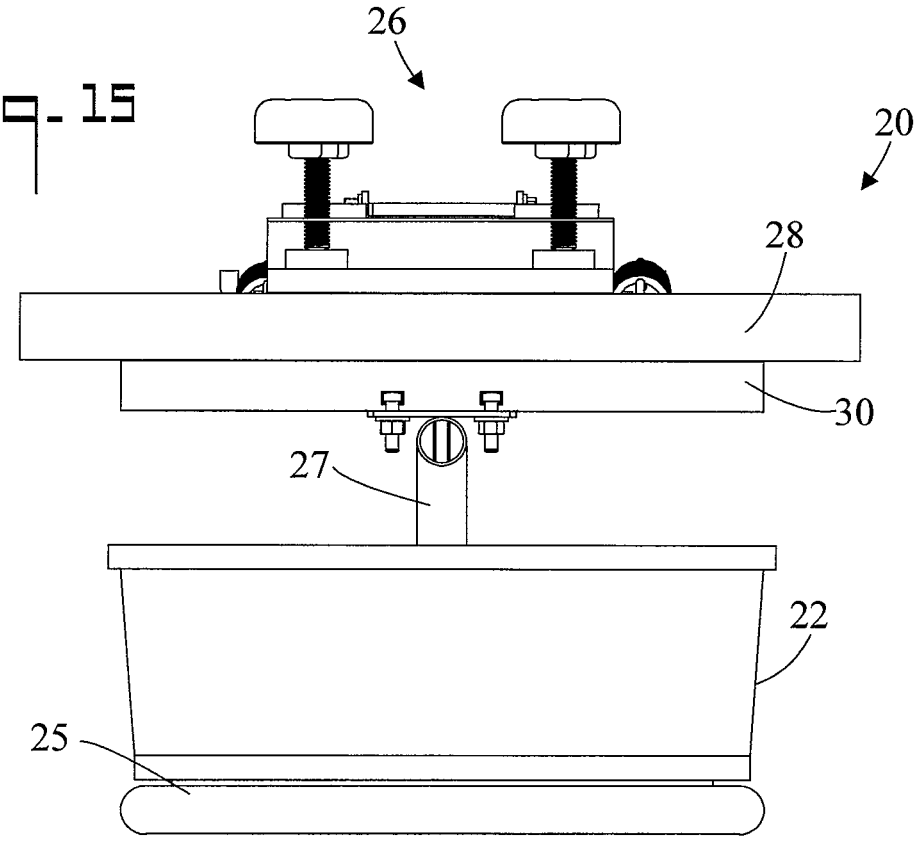
FIG. 15 is a front elevation view of the screen printing press.

Referring to FIG. 2, base 24 includes an open frame which defines a volume 32 which is shaped and dimensioned to receive burn unit 22, so that when burn unit 22 is placed within volume 32 burn unit 22 is visible as is shown in FIG. 1 (also refer to FIGS. 14 and 15). In the shown embodiment, the frame has a substantially rectangular bottom section 25 which receives burn unit 22, and which is connected to clamping mechanism 26 by an upstanding member 27. It is noted that platen 30 is disposed between clamping mechanism 26 and bottom section 25. Platen 30 and bottom section 25 define volume 32 therebetween which is shaped and dimensioned to receive burn unit 22. Also in the shown embodiment, the frame is fabricated from a bent elongated member such as a metal tube. Burn unit 22 is stored in open base 24 for display purposes as is shown in FIGS. 14 and 15, but in not stored when it is being used to burn screens 28 (refer to FIG. 17) or during substrate printing (refer to FIG. 10). This storage and display feature provides the look of an "all-in-one" press (a press with an integrated burn unit), but without the inherent disadvantages of that design approach.

FIGS. 3-5 are top plan, side elevation, and bottom plan views respectively of screen 28. FIG. 3A is an enlarged view of area 3A of FIG. 3. Screen 28 comprises a four-sided frame over which a mesh material is stretched. Typically each screen 28 is used to print only one color on a substrate (refer also to FIGS. 16 and 17) Screen 28 includes a registration side 29 (one of the four sides of the frame) which is clamped by clamping mechanism 26 (refer to FIGS. 7 and 8). Registration side 29 has a first surface 34 and a second surface 36 disposed perpendicular to first surface 34 (also refer to FIGS. 11 and 12). In the shown embodiment, first surface 34 is the edge of registration side 29, and second surface 36 is the bottom of registration side 29. A protruding stop 38 is disposed on at least one of first surface 34 and second surface 36. That is, protruding stop 38 juts out from at least one of first surface 34 and second surface 36. In the shown embodiment protruding stop 38 is disposed on first surface 34 of registration side 29, and is of raised rectangle shape, however other stop shapes could also be used. It is noted in FIG. 3 (and in FIGS. 7 and 8) that protruding stop 38 has a registration edge 39, and that registration edge 39 is the only part of protruding stop 38 which abuts edge 44 of clamping mechanism 26. In the shown embodiment, protruding stop 38 has a single straight registration edge 39. Another possible location for stop 38 (shown in dashed lines) is on second surface 36. Or, stops 38 could be disposed on both surface 34 and surface 36. That is, one protruding stop 38 is disposed on first surface 34 of registration side 29 of screen 28, and another protruding stop 38 is disposed on second surface 36 of registration side 29 of screen 28. As is discussed below, protruding stop 38 is used to register screen 28 in one axis in clamping mechanism 26. In an embodiment, the screens 28 for each different color (e.g. red, blue, yellow, etc.) will each have a protruding stop 38 disposed in the same location. It is noted that registration side 29 has a longitudinal axis L. Referring to FIG. 3A, it is noted that registration edge 39 extends perpendicular to longitudinal axis L of registration side 29. In FIGS. 3, 3A, 4, and 8 it is noted that registration edge 39 is contiguous with one of first surface 34 (shown) and second surface 36 of registration side 29. It is also noted that registration edge 39 is perpendicular to both first surface 34 and second surface 36 of registration side 29. It is further noted that screen 28 is positionable in clamping mechanism 26 so that longitudinal axis L of registration side 29 is parallel with said X axis, and registration edge 39 of protruding stop 38 abuts the edge 44 of the clamping mechanism 26. It is further noted that registration edge 39 defines a registration surface which is perpendicular to first surface 34, perpendicular to second surface 36, and perpendicular to longitudinal axis L.

Figure 6:
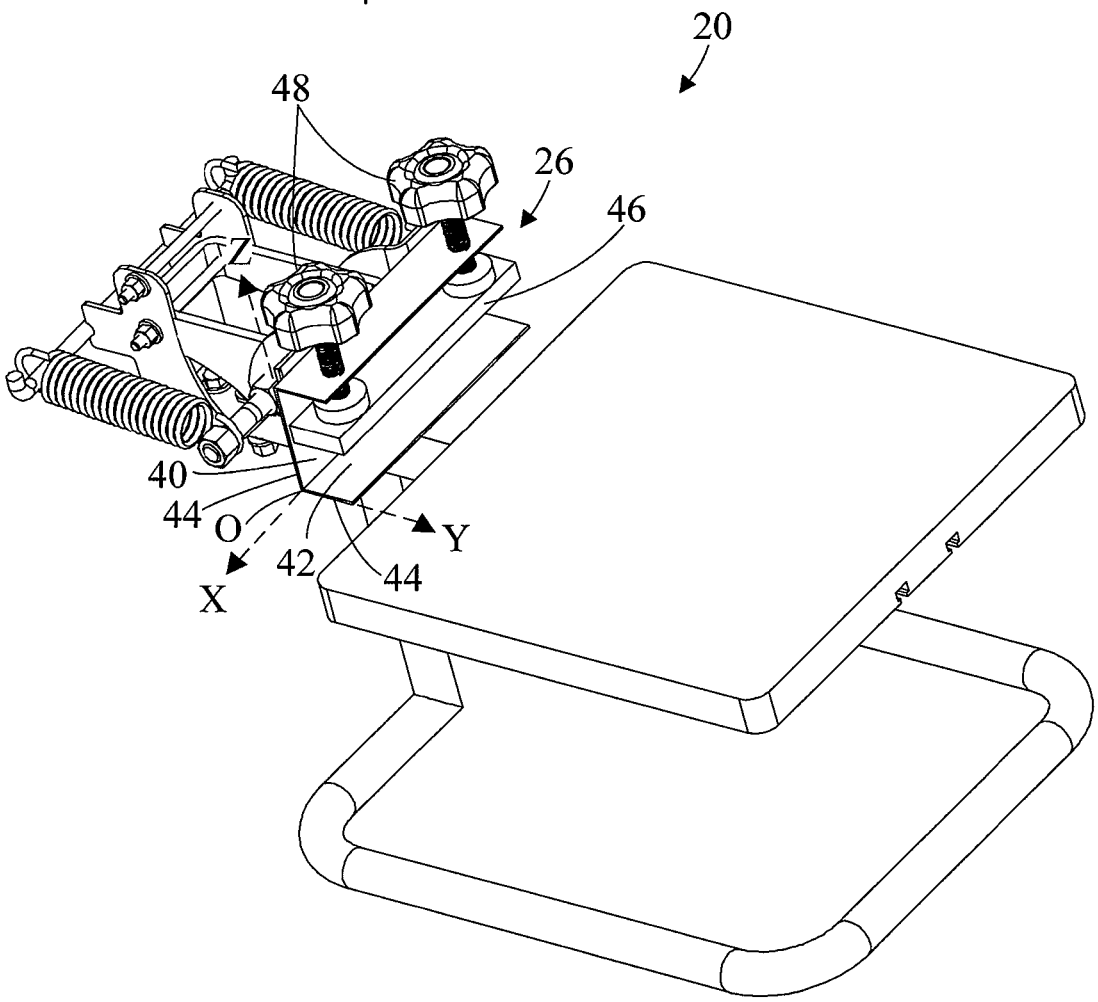
FIG. 6 is a perspective view of the screen printing press without the screen and burn unit installed.

FIG. 6 is a perspective view of the screen printing press 20 without the screen 28 and burn unit 22 installed. Clamping mechanism 26 has a first member 40, a second member 42 disposed perpendicular to said first member, and an edge 44. In the shown embodiment clamping mechanism 26 includes a U-shaped channel wherein first member 40 is a back plate, second member 42 is a bottom plate, and U-shaped edge 44. Clamping mechanism 26 also includes a locking plate 46 and two screws 48 which lock screen 28 in place (also refer to FIGS. 7 and 8).

Also referring to FIGS. 3-5, 7, 8, 10, 11, and 13 screen 28 is inserted into clamping mechanism 26 and locking plate 46/screws 48 are used to clamp screen 28 firmly in place. Screen 28 is positionable in clamping mechanism 26 so that first surface 34 of registration side 29 abuts first member 40 of clamping mechanism 26, second surface 36 of registration side 29 abuts second member 42 of clamping mechanism 26, and protruding stop 38 abuts edge 44 of clamping mechanism 26. As such, screen 28 is fixedly positioned (registered) in three axes with respect to clamping mechanism 26. This ensures that the screens 28 for different color printing (e.g. red, blue, yellow, etc.) will all be aligned with respect to clamping mechanism 26 and with the substrate 500 upon which they are used to print (refer to FIG. 10) In other words, in the shown embodiment screen 28 is simply registered by causing one surface 34 to abut a back plate 40, another surface 36 to abut a bottom plate 42, and stop 38 to abut edge 44. It is noted that in the shown embodiment, edge 44 is part of first member 40 and part of second member 42.

Figure 7:
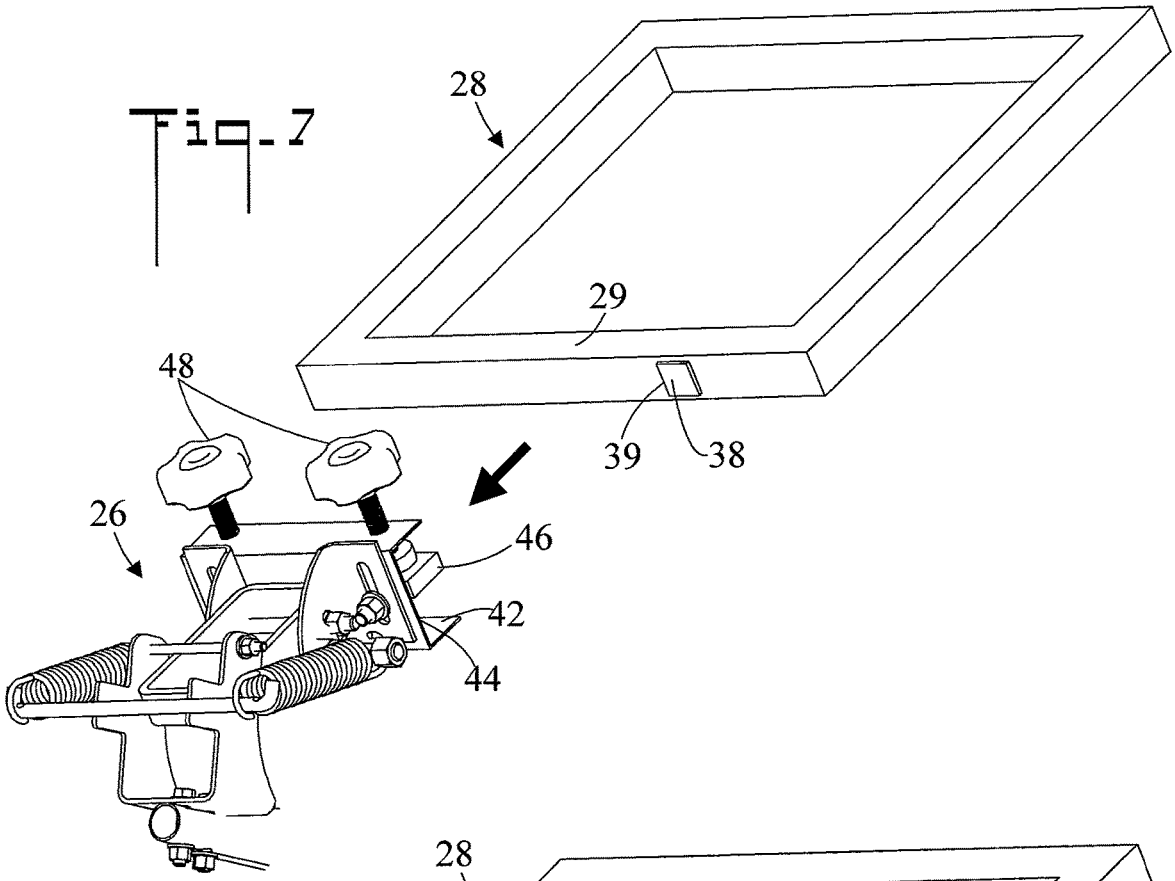
FIG. 7 is an enlarged fragmented perspective view of the screen ready to be installed in a clamping mechanism.
Figure 8:
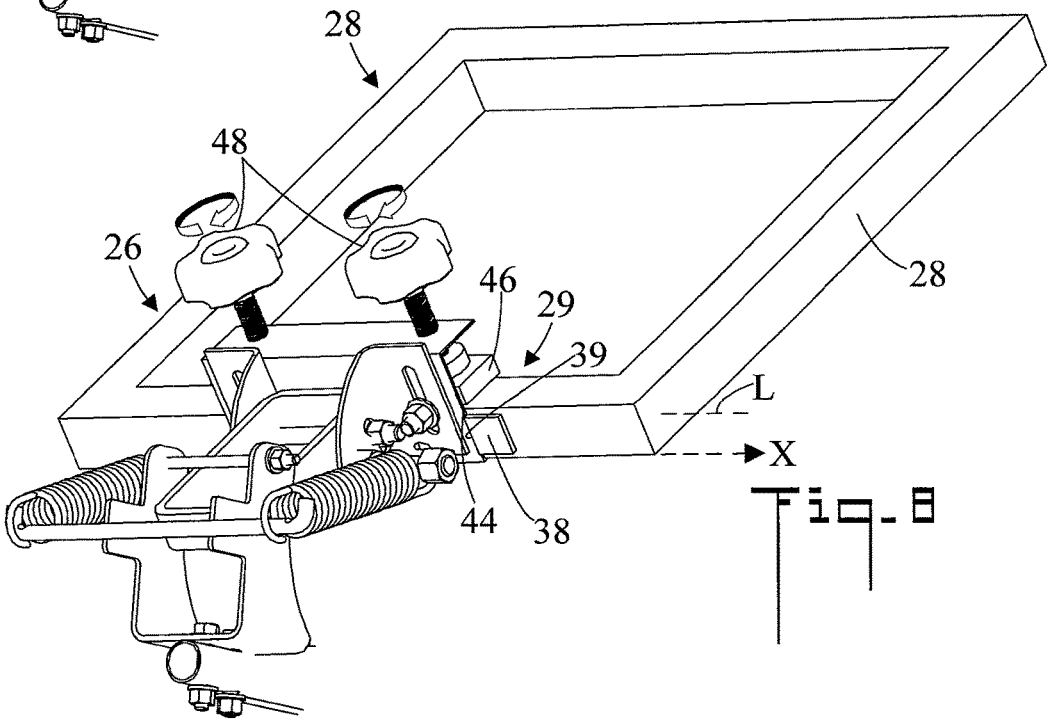
FIG. 8 is an enlarged fragmented perspective view of the screen installed in the clamping mechanism.

Referring to FIG. 6, clamping mechanism 26 has three axes, X, Y, and Z having a common origin O. With respect to the X axis, origin O is defined by edge 44. With respect to the Y axis, origin O is defined by first member 40 (a back plate as shown). With respect to the Z axis, origin O is defined by second member 42 (a bottom plate as shown). As shown in FIGS. 7 and 8 and described above, screen 28 is positioned in clamping mechanism 26 such that it is registered at the origin O of all three axes X, Y, and Z. This simplified alignment system provides a significant advantage over the prior art, which includes more complicated registration apparatus. It is noted that first member 40 provides registration of screen 28 only in the Y axis, second member 42 provides registration of screen 28 only in the Z axis, and that protruding stop 38 provides registration of screen 28 only in the X axis. Moreover, it is noted that in the shown embodiment of FIGS. 7-10 registration side 29 includes a single protruding stop 38.

FIG. 7 is an enlarged fragmented perspective view of screen 28 ready to be installed in clamping mechanism 26, and FIG. 8 is an enlarged fragmented perspective view of screen 28 installed in clamping mechanism 26. Screen 28 is registered in clamping mechanism 26 as described above, and then clamped in place by locking plate 46 using screws 48. Screen 28 is then lowered into a position parallel to platen 30 as shown in FIG. 10. It is noted that screen 28 is removed from clamping mechanism 26 by unscrewing screws 48. It is further noted that in the installed position of FIG. 8, protruding stop 38 abuts edge 44 of clamping mechanism 26, thereby registering screen 28 in the X axis (refer to FIG. 6).

FIGS. 9 and 10 are top plan and side elevation views respectively of screen printing press 20 without the burn unit 22 installed. Shown are base 24 having bottom section 25 and upstanding member 27, clamping mechanism 26 having first member 40 second member 42, and edge 44, screen 28 having protruding stop 38, platen 30, and locking plate 46. FIG. 10 shows a substrate 500 (such as a T-shirt installed on platen) ready to be printed upon.

Referring to FIGS. 8 and 9, it is noted that screen 28 is positionable in clamping mechanism 26 so that longitudinal axis L of registration side 29 of screen 28 is parallel with the X axis. When so positioned, edge 44 is perpendicular to longitudinal axis L of registration side 29, and registration edge 39 of protruding stop 38 abuts edge 44 of clamping mechanism 26. Clamping mechanism 26 has a transverse axis C. In FIG. 9, it is further noted that when screen 28 is registered in clamping mechanism 26, screen is substantially centered (on transverse axis C) in clamping mechanism 26. The position of protruding stop 38 along longitudinal axis L of registration side 29 causes screen 28 to be substantially centered in clamping mechanism 26.

Figure 11:
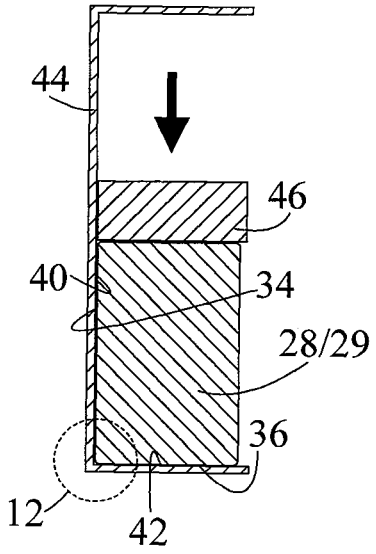
FIG. 11 is an enlarged cross sectional view along the line 11-11 of FIG. 9.

FIG. 11 is an enlarged cross sectional view along the line 11-11 of FIG. 9. Registration side 29 of screen 28 is clamped in place in clamping mechanism 26 such that first surface 34 of registration side 29 abuts first member 40 (e.g. back plate) of clamping mechanism 26, second surface 36 of registration side 29 abuts second member 42 (e.g. bottom plate) of clamping mechanism 26. Locking plate 46 urges second surface 36 into contact with second member 42.

Figure 12:
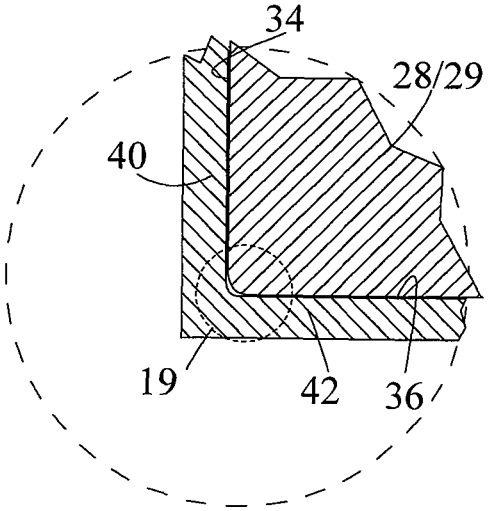
FIG. 12 is an enlarged view of area 12 of FIG. 11.
Figure 19:
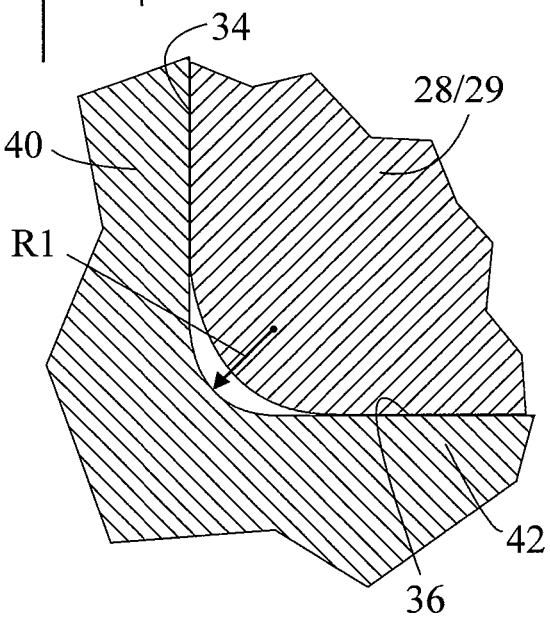
FIG. 19 is an enlarged view of area 19 of FIG. 12 showing a first radius of curvature R1, and, FIG. 20 is an enlarged view as in FIG. 19 showing a second radius of curvature R2.
Figure 20:
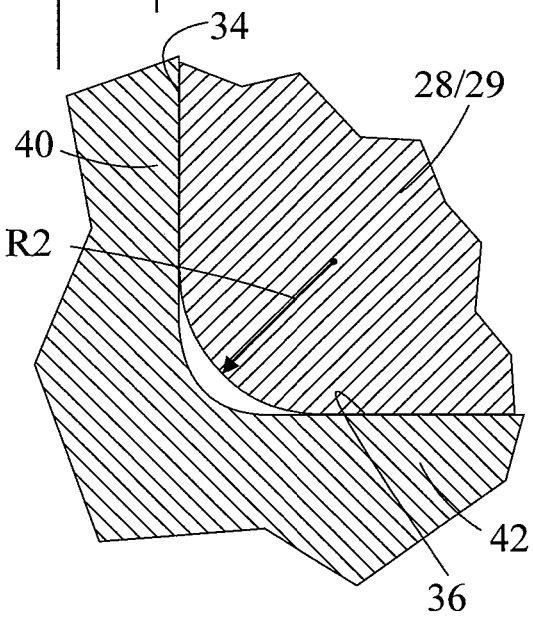

FIG. 12 is an enlarged view of area 12 of FIG. 11. In order for screen 28 to properly register with first member 40 and second member 42, a radius of curvature relationship must exist. For purposes of discussion, in the shown embodiment first member 40 is a back plate and second member 42 is a bottom plate. A junction of back plate 40 with bottom plate 42 has a first radius of curvature R1 (refer to FIG. 19). A junction of first surface 34 of registration side 29 with second surface 36 of registration side 29 has a second radius of curvature R2 (refer to FIG. 20), the second radius of curvature R2 must be equal to or greater than the first radius of curvature R1. This relationship ensures that screen 28 will properly seat in the U-shaped member particularly in the Y axis (refer to FIG. 6).

Figure 13:
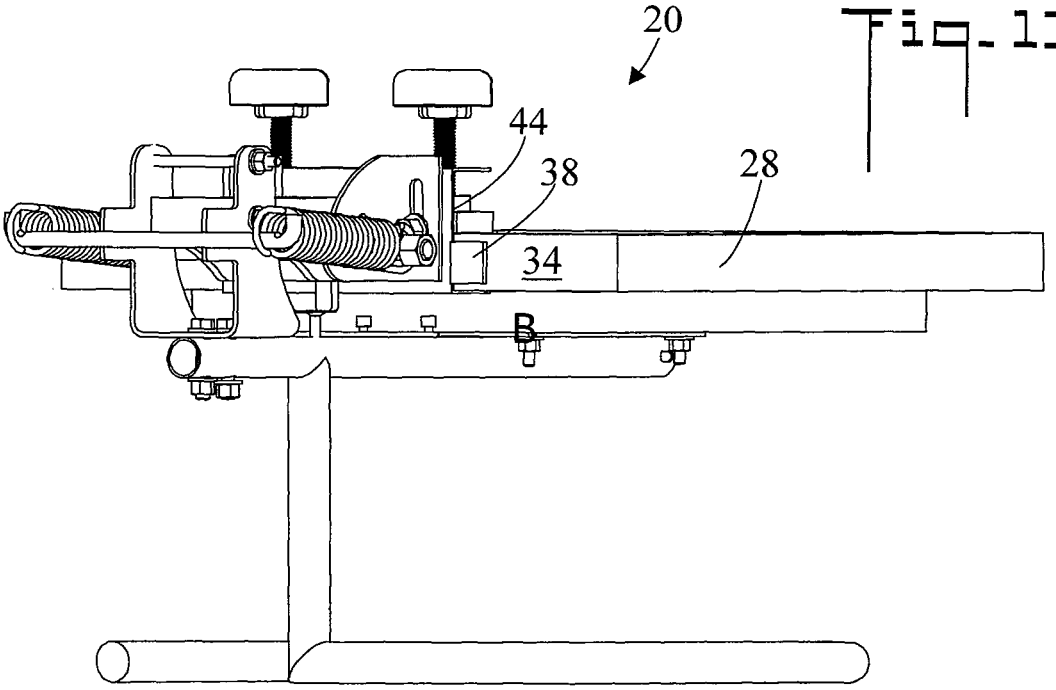
FIG. 13 is a perspective view of the screen printing press without the burn unit installed.

FIG. 13 is a perspective view of screen printing press 20 without burn unit 22 installed. Shown are screen 28, protruding stop 38, and edge 44.

FIGS. 14 and 15 are side elevation and front elevation views respectively of screen printing press 20. Shown are installed (docked) burn unit 22, base 24, bottom section 25, clamping mechanism 26, upstanding member 27, screen 28, and platen 30.

Figure 16:
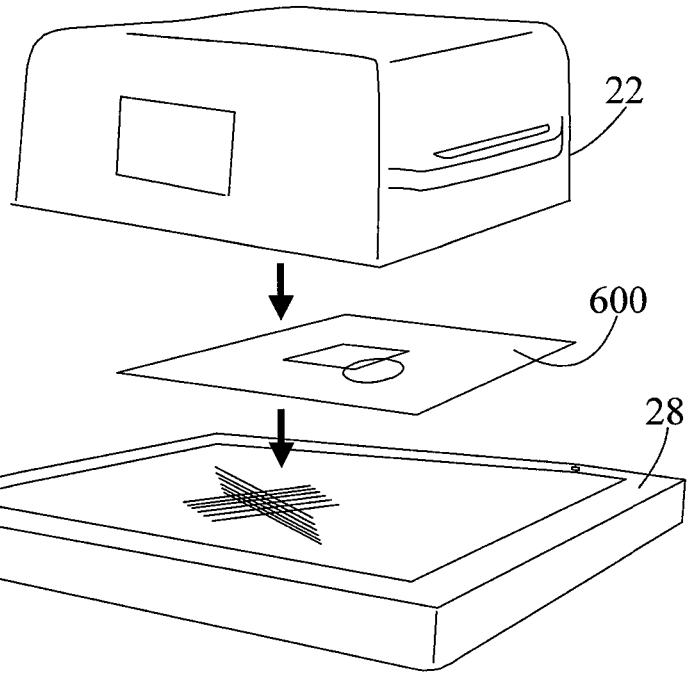
FIG. 16 is an exploded perspective view of the burn unit being positioned on the screen.
Figure 17:
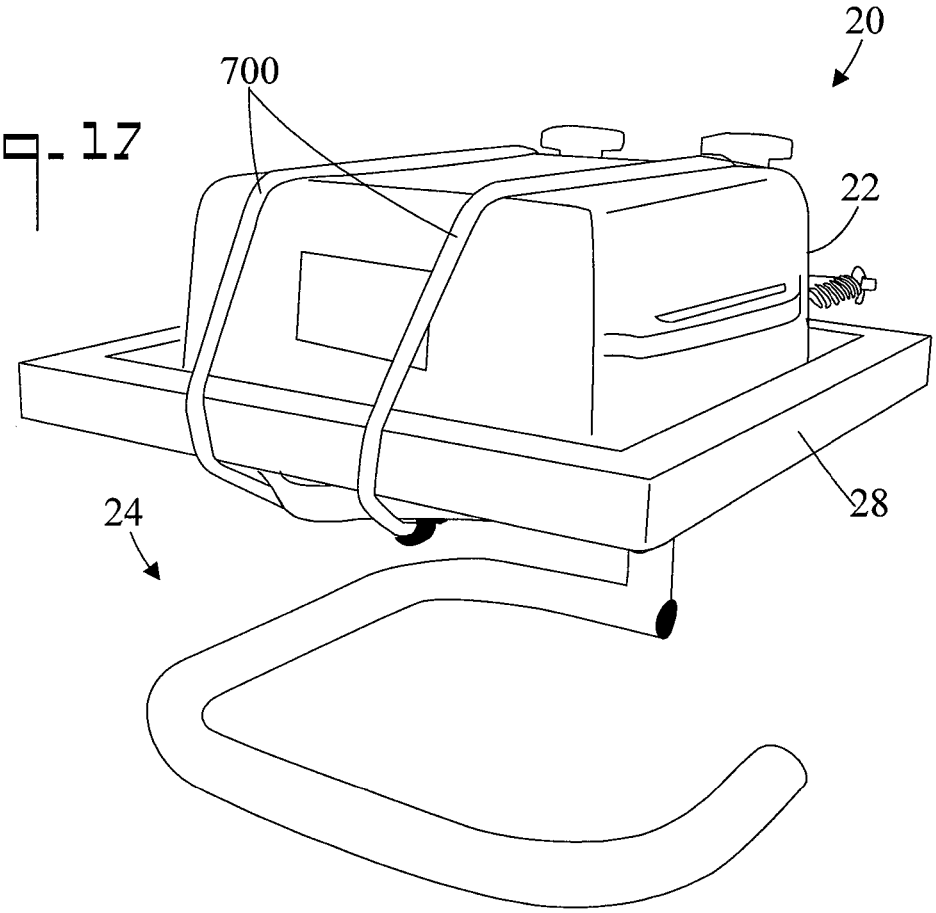
FIG. 17 is a perspective view of the burn unit positioned upon the screen and connected to the base.

FIG. 16 is an exploded perspective view of burn unit 22 being positioned on screen 28, and FIG. 17 is a perspective view of burn unit 22 positioned on screen 28 and connected to base 24. Burn unit 22 is used to expose screens 28 which are coated with a photo emulsion in order to create printing stencils. A film transparency 600 having a positive image is placed on screen 28. Burn unit 22 is removed from the storage position of FIG. 1, and placed glass side down on top of film transparency 600 and screen 28. An anchoring device such as the shown bungee cords 700 are then used to hold burn unit 22 against film transparency 600 and screen 28. Burn unit 22 is then turned on to expose "burn" the emulsion. Burn unit 22 and screen 28 are then disconnected, and screen 28 is washed to remove the unexposed emulsion (the areas where light was blocked by the positive image of the transparency). If other colors are required, then the above process is repeated for each color with a different screen 28. It is noted that in the shown embodiment, the burning of screen 28 is performed on screen printing press 20 with screen 28 installed and registered as described above. However, it may also be appreciated that screen 28 could be burned at a remote location. After screen(s) 28 is burned, a substrate 500 such as a T-shirt is placed on platen 30 below screen 28 and ink is applied (refer to FIG. 10).

Screen printing press 20 can be used in different ways. In one embodiment, burn unit 22 is docked in base 24 as shown in FIGS. 14 and 15. Burn unit 22 is then removed (undocked) to perform on-unit screen burning as is shown in FIG. 17. So that it is out of the way, burn unit 22 is then removed from the workspace to perform substrate printing as is shown in FIG. 10. After printing, burn unit 22 is re-docked in base 24 for storage and display. In another embodiment, as before burn unit 22 is initially docked in base 24. Burn unit 22 is then taken to a remote location to perform screen burning. After substrate printing is performed, burn unit 22 is returned to base 24 for storage and display.

Figure 18:
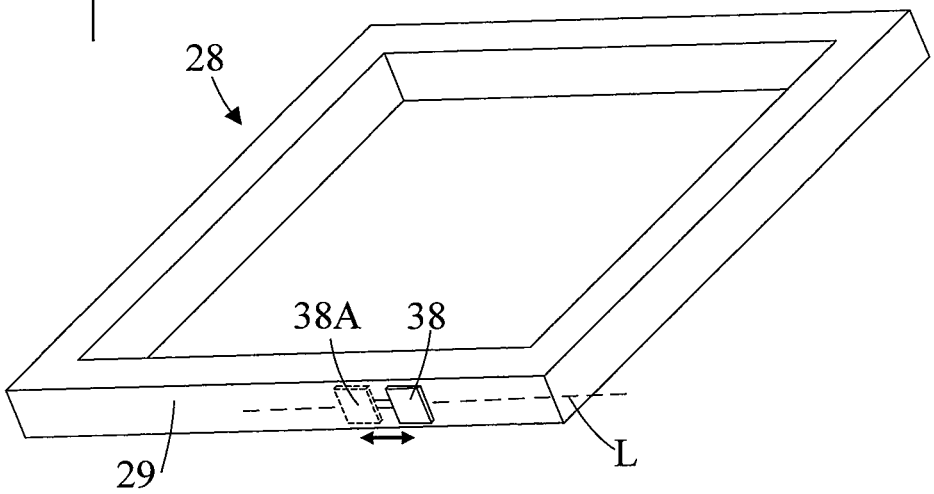
FIG. 18 is a perspective view of a screen having a positionable protruding stop.

FIG. 18 is a perspective view of a screen 28 having a positionable protruding stop 38. That is, protruding stop 38 is positionable along the longitudinal axis.L of registration side 29 of screen 28. In this embodiment protruding stop 38 can be moved to two or more desired positions along longitudinal axis L, thereby changing the registration in the X axis (refer to FIG. 6). This feature is useful in some screen printing applications. In the shown embodiment, protruding stop 38 can be selectively moved between the position shown in solid lines 38 and the position shown in dashed lines 38A, and to any position therebetween. The movement of protruding stop 38 can be effected by various mechanical means known to those skilled in the art, such as a sliding mechanism, a plurality of detent positions, and the like. Once in the desired position, protruding stop 38 can be locked firmly in place.

The embodiments of the screen printing press described herein are exemplary and numerous modifications, combinations, variations, and rearrangements can be readily envisioned to achieve an equivalent result, all of which are intended to be embraced within the scope of the appended claims. Further, nothing in the above-provided discussions of the screen printing press should be construed as limiting the invention to a particular embodiment or combination of embodiments. The scope of the invention is defined by the appended claims.

I claim:

1. A screen printing press, comprising:

a base;

a clamping mechanism connected to said base, said clamping mechanism having a first member, a second member, and an edge;

a screen which is shaped and dimensioned to be received and clamped by said clamping mechanism, said screen including a registration side having a first surface and a second surface disposed perpendicular to said first surface, a protruding stop disposed on said registration side, and said registration side having a longitudinal axis;

said clamping mechanism having a X axis, a Y axis, and a Z axis, said axes having a common origin, wherein in said X axis said origin is said edge, in said Y axis said origin is said first member, and in said Z axis said origin is said second member;

said first member providing registration of said screen only in said Y axis;

said second member providing registration of said screen only in said Z axis;

said protruding stop providing registration of said screen only in said X axis;

said screen is positionable in said clamping mechanism so that said first surface of said registration side abuts said first member of said clamping mechanism, said second surface of said registration side abuts said second member of said clamping mechanism, and said protruding stop abuts said edge of said clamping mechanism; and said protruding stop having a registration edge which is perpendicular to said longitudinal axis of said registration side, said registration edge being contiguous with one of said first surface and said second surface of said registration side.

2. The screen printing press according to claim 1, further including:

said screen is positionable in said clamping mechanism so that (1) said longitudinal axis of said registration side of said screen is parallel with said X axis, (2) said registration edge provides registration of said screen in said X axis, and, (3) said edge of said clamping mechanism is perpendicular to said longitudinal axis of said registration side.

3. The screen printing press according to claim 1, further including:

said screen positionable in said clamping mechanism so that said longitudinal axis of said registration side is parallel with said X axis, and said registration edge of said protruding stop abuts said edge of said clamping mechanism.

4. The screen printing press according to claim 1, further including:

said first member being a back plate wherein said first surface of said registration side directly abuts said back plate; and, said second member being a bottom plate wherein said second surface of said registration side directly abuts said bottom plate.

5. The screen printing press according to claim 1, further including:

said registration edge defining a registration surface which is perpendicular to said first surface, perpendicular to said second surface, and perpendicular to said longitudinal axis.

6. The screen printing press according to claim 1, further including:

a position of said protruding stop along said longitudinal axis of said registration side causing said screen to be substantially centered in said clamping mechanism.

7. The screen printing press according to claim 1, further including:

said protruding stop being positionable along said longitudinal axis to two or more desired positions.

8. A device for a screen printing press, the screen printing press including a base, a clamping mechanism connected to the base, the clamping mechanism having a first member, a second member, an edge, and a X axis, the device comprising:

a screen which is shaped and dimensioned to be received and clamped by the clamping mechanism, said screen including a registration side having a first surface and a second surface disposed perpendicular to said first surface, a protruding stop disposed on said registration side, and said registration side having a longitudinal axis;

said screen is positionable in the clamping mechanism so that said first surface of said registration side abuts the first member of the clamping mechanism, said second surface of said registration side abuts the second member of the clamping mechanism, and said protruding stop abuts the edge of the clamping mechanism, and said longitudinal axis of said registration side of said screen is parallel with the X axis;

said protruding stop having a registration edge which is contiguous with one of said first surface and said second surface of said registration side; and, said registration edge defining a registration surface which is perpendicular to said first surface, perpendicular to said second surface, and perpendicular to said longitudinal axis.

9. The device according to claim 8, further including:

said screen positionable in said clamping mechanism so that said longitudinal axis of said registration side is parallel with the X axis, and said registration edge of said protruding stop abuts the edge of the clamping mechanism.

10. The device according to claim 8, further including:

a position of said protruding stop along said longitudinal axis of said registration side causing said screen to be substantially centered in the clamping mechanism.

11. The screen printing press according to claim 8, further including:

said protruding stop being positionable along said longitudinal axis to two or more desired positions.

* * * * *